United States Patent [19]

Lang

[11] 4,087,028

[45] May 2, 1978

[54] SNAP LOCK DISPENSING CAP

[76] Inventor: Frank J. Lang, 11702 Center Dr., Lemont, Ill. 60439

[21] Appl. No.: 751,242

[22] Filed: Dec. 16, 1976

[51] Int. Cl.[2] ..... B67D 3/00

[52] U.S. Cl. ..... 222/556

[58] Field of Search ..... 222/556, 558

[56] References Cited

U.S. PATENT DOCUMENTS

| | | | |
|---|---|---|---|
| 1,951,610 | 3/1934 | Hennen | 222/558 X |
| 1,977,302 | 10/1934 | Brill | 222/558 X |
| 2,044,837 | 6/1936 | Davis | 222/558 X |
| 3,369,720 | 2/1968 | Libit et al. | 222/558 X |

*Primary Examiner*—Joseph F. Peters, Jr.
*Assistant Examiner*—Norman L. Stack, Jr.
*Attorney, Agent, or Firm*—Francis J. Bouda

[57] ABSTRACT

A molded plastic closure for a dispensing bottle for liquid or viscous material, which closure includes a body portion and a cap, the cap, being pivotally secured to the body along an integral hinge line, the cap having a button-like portion and the body having an opening, the distance between the hinge and the opening in the body being slightly less than the distance between the hinge and the button on the cap to provide a snap-lock closure which is leakproof when the cap is in place over the body and the button is stressed against the opening.

5 Claims, 7 Drawing Figures

SNAP LOCK DISPENSING CAP

BACKGROUND OF THE INVENTION

Plastic caps or closures for fluid and viscous material dispensers are not new, and the plastic molding industry has provided a wide assortment of closures for spray-type containers, liquid dispensing containers and paste-type dispensers. Such closures are generally threaded or press-fitted to the top of a bottle tube or can, and are arranged to be opened easily so that the contents of the container may be dispensed through the closure.

However, in the past, most of these closures have been either tow-part devices with a body portion fitted to the container and a separate cap which is snapped or screwed to the body, or, in some instances, have comprised a body and a cap portion which are molded with a self-hinge, but wherein the cap is held against the body because the diameter of the opening of the body and the diameter of the cap have been selected so that the differential diameters of the two portions provide the retaining forces necessary to keep the cap in place on the body. Such closures are indicated by U.S. Pat. No. 3,300,104 (1967), RE 25703 (1964) and the like. Note also U.S. Pat. No. 2,778,533 (1957) which illustrates the method of molding a body and cap member with a strap-type hinge for providing an integral cap and body closure wherein the differential diameters hold the cap in place on the body.

However, utilitarian such prior art devices may be, I have found it desirable to provide a one-piece closure having a cap and body with a self-hinge about which the cap pivots to snapfit on to the body. I employ the tensioning force between the integral hinge and the orifice in the body, and the integral hinge and the button on the cap, to provide the necessary fluid-tight seal.

SUMMARY OF THE INVENTION

It will be seen that the closure of the present invention includes a body portion and a cap portion with an integral hinge connecting the two and wherein the distance from the hinge to the orifice of the body is slightly less than the distance from the hinge to the button on the cap so that when the cap is pivoted about the hinge into position above and around the body, the tensioning forces created by stretching the cap to snap the button into place over the opening are sufficient to pull the button tightly into place against the opening and provide a fluid-tight seal for the closure.

Thus the closure of the present invention is found to be relatively simple and uncomplicated, being easily operable with one hand (a situation highly desirable when the cap is used on a toothpaste tube for instance) to provide a type of closure for a fluid dispensing container which has heretofore not been available.

The principle object of the present invention is to provide a reusable closure having an integral hinge connecting a body portion and a cap portion to provide tensioning forces to hold the cap in fluid-tight disposition around the body when the two are interlocked.

A further object of the present invention is to provide a reclosable fluid-tight cap having integral hinge with inherent tensioning forces, which can be used with paste dispensing containers, liquid dispensing containers, and spray dispensing containers.

An additional object of the present invention is to provide a reclosable fluid-tight plastic dispensing cap for a fluid container which can be either threaded or press-fittedly attached to the container and which may be used selectively on metal containers, plastic containers, or glass containers.

Still another object of the present invention is to provide an inexpensive one piece, fluid-tight snap-fitted dispensing cap for fluid containers which does not rely on differential diameters of the various members to provide the fluid-tight seal.

With the above and other objects in view, more information and understanding of the present invention may be achieved by reference to the following description.

DETAILED DESCRIPTION

For the purpose of illustrating the invention, there are shown on the accompanying drawing forms thereof which are at present preferred, although it is to be understood that the various instrumentalities of which the invention consists can be variously arranged and organized and that the invention is not limited to the precise arrangements and organizations of the instrumentalities as herein shown and described.

In the drawings wherein like reference characters indicate like parts:

Figure 1:
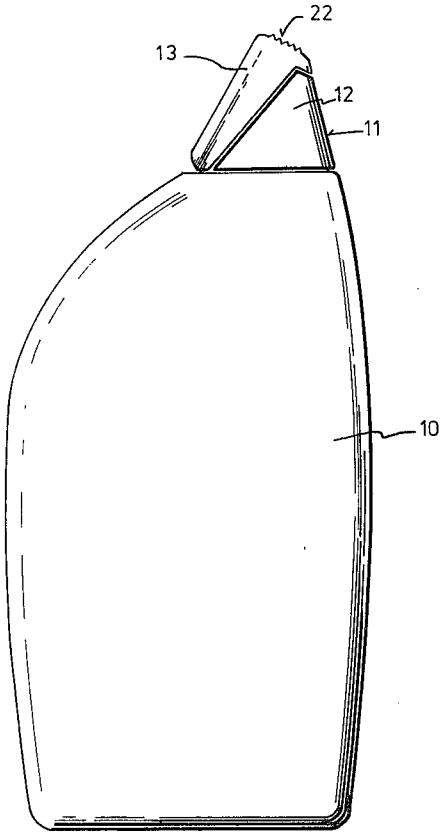
FIG. 1 is a front elevational view of a liquid dispensing container with the cap of the present invention fitted at the top thereof.

With reference to FIG. 1, a plastic squeeze-type bottle 10 of the type generally used to dispense suntan lotions or similar materials has a closure 11 fitted at the top thereof. Said closure includes a body portion 12 and a cap portion 13. The body portion may be affixed to the bottle by screw threads, snap-fit, adhesively, or in any other desirable manner.

Figure 2:
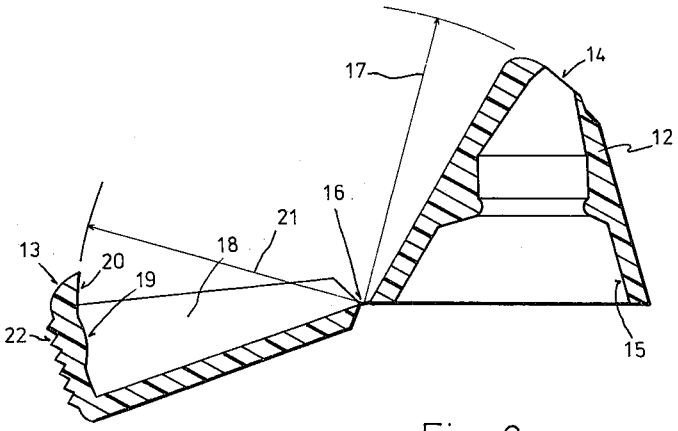
FIG. 2 is a vertical cross-sectional view of the closure of the present invention with the cap portion pivoted away from the body portion.

With reference to FIG. 2, it can be seen that the body portion 12 has an orifice 14 at the top and a larger opening 15 at the bottom. The opening 15 is adapted to fit the neck of the bottle 11 and the orifice 14 is connected thereto so that the contents of the bottle may be dispensed through the opening 14.

At one side of the body 12 is a hinge 16 which is preferably a self-hinge integrally connecting the body 12 and the cap 13 formed in moulding process.

The distance from the hinge 16 to the orifice 14 is indicated by the arrow 17 and this dimension may be chosen to provide the necessary aesthetics for the closure, as well as to relate to the relative dimensions of the cap and the bottle.

In the cap 13, the recess 18 is formed so that the cap 13 may partially envelop the body 12, with a button 19 on the underside 20 of the upper portion of the recess 18. The length of the cap 13 is indicated by the arrow 21, and this dimension is only slightly larger than the dimension indicated by the arrow 17.

However, as can be seen clearly in FIG. 2, the button 19 extends into the recess 18 and thus is closer to the hinge than the underside 20 of the cap 13 and also closer than the orifice 14 so that when the cap 13 is pivoted about the hinge 16, the recess 18 fits about the upper portion of the body with the underside 20 of the cap 13 passing over the top of the body, forcing the button 19 to ride along the upper surface of the body. Shortly thereafter, the button 19 snaps back against the opening or orifice 14 under the tension created by the stressed cap, thus providing an airtight and fluid tight closure between cap and body.

It will be noted that the outer, upper surface of the cap 13 is serrated as at 22 to provide an anti-slip surface against which the thumb of the user may be placed to facilitate onehanded operation.

Figure 4:
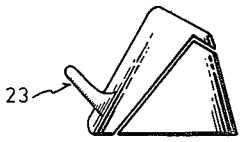
FIG. 4 is a front elevational view of an optional form of the closure of the present invention.

In FIG. 4, I have shown a version of thumblatch 23 which also facilitates one-hand operation of the closure of the present invention.

Figure 5:
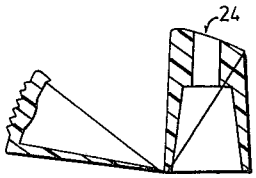
FIG. 5 is a front elevational view of a different form of the closure of the present invention.
Figure 3:
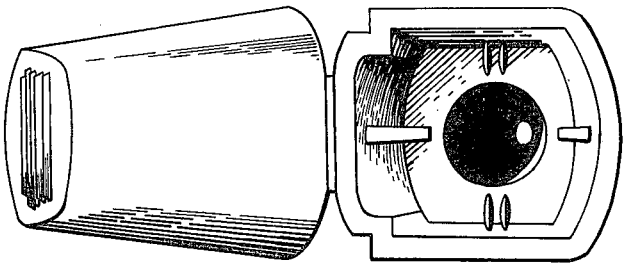
FIG. 3 is a bottom plan view of the closure of the present invention.

FIG. 5 illustrates a cap of the present invention similar to that heretofore described, but showing a larger opening 24 in the body portion, particularly adapted for the dispensing of viscous material such as toothpaste.

Figure 6:
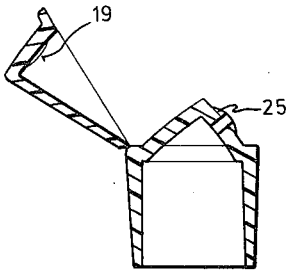
FIG. 6 is a front elevational view of yet another form of the closure of the present invention.

In FIG. 6, there is shown still another version of the cap and body arrangement wherein the body portion has a separate dimple 25 affixed to the orifice to provide appropriate spray control of the liquid. The dimple has an opening against which the button 19 may be pressed to create the seal.

Figure 7:
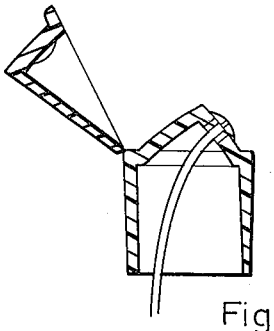
FIG. 7 is a front elevational view of still a different form of the closure of the present invention.

FIG. 7 illustrates how a spray-type siphon tube may be affixed to the orifice in the body portion to provide a dispensing mechanism for the liquids which are preferably squirted from a spray container.

It is to be understood that the present invention may be embodied in other specific forms without departing from the spirit or special attributes hereof, and it is, therefore, desired that the present embodiments be considered in all respects as illustrative and, therefore, not restrictive, reference being made to the appended claims rather than to the foregoing description to indicate the scope of the invention.

Having thus described my invention, what I claim as new and desire to protect by Letters Patent are the following:

1. A universal, plastic, one-piece, snap-type closure for a variety of containers of the type having a dispensing opening, the closure having a body-portion for mounting on the container adjacent its opening and also having a capportion, the body-portion having an orifice in a wall portion remote from the dispensing opening of the container, the cap portion having a dimple for sealing the orifice of the body portion, a unitary hinge having an axis and forming an integral connection between the body-portion and the cap-portion, the distance from the axis of the hinge to the orifice being greater than the distance from the axis of the hinge to the dimple, the cap-portion being arranged to pivot over the body-portion about the hinge so that the dimple fits over the orifice, the axis of the hinge being off-center and at one side of the body-portion, the wall portion in the body portion being approximately at a right angle to a line drawn between the orifice and the axis, inherent tension between the body-portion and the cap-portion causing a fluid-tight seal of dimple against orifice when the dimple and the orifice are in juxtaposition.

2. The snap-type dispensing closure of claim 1 wherein the orifice is a large diameter opening adapted to receive thick viscous paste-type material.

3. The snap-type dispensing closure of claim 1 wherein the orifice is constructed and arranged with a button to provide for dispensing of liquid material therethrough.

4. The snap-type dispensing closure of claim 1 wherein the orifice has a spray-type dispensing member disposed therein.

5. A universal, plastic, one-piece, snap-type closure for a variety of containers of the type having a dispensing opening, the closure having a body-portion for mounting on the container adjacent its opening and also having a cap-portion, the body-portion having an orifice in a wall portion remote from the dispensing opening of the container, the cap portion having a dimple for sealing the orifice of the body portion, a unitary hinge having an axis and forming an integral connection between the body-portion and the cap-portion, the distance from the axis of the hinge to the orifice being greater than the distance from the axis of the hinge to the dimple, the cap-portion being arranged to pivot over the body-portion about the hinge so that the dimple fits over the orifice, the axis of the hinge being off-center and at one side of the body-portion, the surface of the cap portion having the dimple thereon being approximately at a right angle to a line drawn between the dimple and the axis, inherent tension between the body-portion and the cap-portion causing a fluid-tight seal of dimple against orifice when the dimple and the orifice are in juxtaposition.

* * * * *